US006383725B2

(12) United States Patent
Loccufier et al.

(10) Patent No.: US 6,383,725 B2
(45) **Date of Patent: *May 7, 2002**

(54) EMULSION FOR A PHOTOTHERMOGRAPHIC MATERIAL, A PRODUCTION PROCESS FOR THE THERMOGRAPHIC MATERIAL AND A RECORDING PROCESS THEREFOR

(75) Inventors: Johan Loccufier, Zwijnaarde; Ivan Hoogmartens, Wilrijk; Hans Strijckers, Oudergem, all of (BE)

(73) Assignee: AGFA-Gevaert (BE)

( * ) Notice: Subject to any disclaimer, the term of this patent is extended or adjusted under 35 U.S.C. 154(b) by 0 days.

This patent is subject to a terminal disclaimer.

(21) Appl. No.: 09/735,733

(22) Filed: Dec. 13, 2000

Related U.S. Application Data

(63) Continuation of application No. 08/889,480, filed on Jul. 8, 1997, now Pat. No. 6,187,516.
(60) Provisional application No. 60/027,498, filed on Sep. 27, 1996.

(30) Foreign Application Priority Data

Jul. 24, 1996 (EP) ..... 96202105

(51) Int. Cl.[7] ..... G03C 1/498
(52) U.S. Cl. ..... 430/350; 430/603; 430/610; 430/617; 430/619; 430/944

(58) Field of Search ..... 430/619, 617, 430/610, 603, 350, 944

(56) References Cited

U.S. PATENT DOCUMENTS

| | | | | |
|---|---|---|---|---|
| 3,957,517 | A | 5/1976 | Ikenoue et al. | |
| 4,173,482 | A | 11/1979 | Akashi et al. | |
| 5,028,523 | A | 7/1991 | Skoug | |
| 6,187,516 | B1 * | 2/2001 | Loccufier et al. | 430/350 |

* cited by examiner

*Primary Examiner*—Thorl Chea
(74) *Attorney, Agent, or Firm*—Leydig, Voit & Mayer, Ltd.

(57) ABSTRACT

An emulsion comprising a substantially light-insensitive organic silver salt, photosensitive silver halide in catalytic association with the substantially light-insensitive organic silver salt and a binder, wherein the emulsion further comprises a polyhalide compound selected from the group consisting of quaternary ammonium polyhalides, quaternary phosphonium polyhalides and ternary sulphonium polyhalides, which satisfies a test specified in the description, or a product of a reaction between the polyhalide compound and a reducing species present in said emulsion; a process for producing a photothermographic recording material, capable of image formation without preliminary heating prior to exposure, comprising a photoaddressable thermally developable element incorporating the emulsion; and a photothermographic recording process utilizing the photothermographic recording material.

21 Claims, No Drawings

EMULSION FOR A PHOTOTHERMOGRAPHIC MATERIAL, A PRODUCTION PROCESS FOR THE THERMOGRAPHIC MATERIAL AND A RECORDING PROCESS THEREFOR

This is a continuation of application Ser. No. 08/889,480 filed Jul. 8, 1997 now U.S. Pat. No. 6,187,576, which claims the benefit of provisional application No. 60/027,498, filed Sep. 27, 1996.

DESCRIPTION

1. Field of the Invention

The present invention relates to an emulsion for a photothermographic material, a production process for the photothermographic material and a recording process therefor.

2. Background of the Invention

Thermal imaging or thermography is a recording process wherein images are generated by the use of imagewise modulated thermal energy.

In thermography three approaches are known:

1. Direct thermal formation of a visible image pattern by imagewise heating of a recording material containing matter that by chemical or physical process changes colour or optical density.

2. Imagewise transfer of an ingredient necessary for the chemical or physical process bringing about changes in colour or optical density to a receptor element.

3. Thermal dye transfer printing wherein a visible image pattern is formed by transfer of a coloured species from an imagewise heated donor element onto a receptor element.

Thermographic materials of type 1 become photothermographic when a photosensitive agent is present which after exposure to UV, visible or IR light is capable of catalyzing or participating in a thermographic process bringing about changes in colour or optical density.

Examples of photothermographic materials are the so called "Dry Silver" photographic materials of the 3M Company, which are reviewed by D. A. Morgan in "Handbook of Imaging Science", edited by A. R. Diamond, page 43, published by Marcel Dekker in 1991.

GB 1 342 525 discloses a photosensitive heat-processable material comprising a support and contained in a layer or layers thereof: (a) an oxidation/reduction image-forming system comprising: (b) a light-insensitive reducible metal compound and (c) an organic reducing agent therefor, (d) a photosensitive silver compound capable, on exposure to actinic radiation, of forming centres which catalyze the thermally induced oxidation/reduction reaction of (b) with (c) to form a visible image, and (e) a substantially colourless photographic speed-increasing onium halide. From the general formulae given in claim 4 of GB-P 1 342 525, the examples of speed-increasing onium halides given in the specification and the onium halides used in the invention examples thereof show that the term halide in this patent is that given in the "McGraw-Hill Dictionary of Scientific and Technical Terms", Ed. S. P. Parker, McGraw-Hill Book Company, New York (1989) i.e. "a compound of the type MX, where X is fluorine, chlorine, bromine or astatine, and M is another element or organic radical". Onium halides are, however, not able to stabilize fully photothermographic materials against fogging.

U.S. Pat. No. 3,957,517 discloses a dry method for the stabization of a print-out silver halide photographic material wherein the silver halide is the image-forming substance, which comprises (1) imagewise exposure of a silver halide photographic emulsion material to form a print-out image, wherein said silver halide photographic emulsion material consists essentially of silver halide grains at least 50 mol % of which consists of silver bromide and 0.1 to 33 mol %, based on the silver halide, of an onium compound having an iodide ion or an anion containing iodine, said onium compound being a member selected from the group consisting of compounds of the formulae:

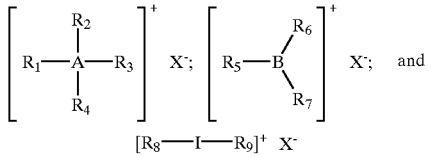

wherein A is N, P, As or Sb, B is O, S, SO, Se or Sn, and each of $R_1$ to $R_9$ is an alkyl group having less than 8 carbon atoms, or an aryl group having less than 16 carbon atoms, or of said $R_1$ to $R_9$ two groups can be connected to each other to form a ring selected from the group consisting of a pyridine ring, a morpholine ring, an oxazine ring, a thiazine ring, a thiazole ring, an oxazole ring, a benzothiazole ring and a benzo-oxazole ring, and wherein X is an iodine ion or an iodine containing anion; and subsequently heating said photographic material to a temperature of at least 80° C., thereby stabilizing said print-out image.

In U.S. Pat. No. 4,173,482 a dry image forming material is disclosed capable of forming an image by preliminary heating, imagewise exposure to light, and heat development thereof, said material comprising (a) a non-photosensitive organic silver salt oxidizing agent, (b) a reducing agent for a silver ion and (c) at least one halogen molecule selected from the group consisting of a bromine molecule, an iodine molecule, iodine chlorides, iodine bromide and bromine chloride and optionally further comprising at least one halogen ion source in addition to said at least one halogen molecule. According to U.S. Pat. No. 4,173,482 (column 3, lines 64–68) the halogen ion source and the halogen molecule may be added separately, or a compound or compounds capable of forming a halogen ion source and a halogen molecule by reaction at the preparation of the image forming material may be used, for example triphenylphosphite nonaiodide. The use of single compound, acting as a halogen ion source and providing a halogen molecule requires the use of an additional preliminary heating step prior to image-wise exposure to actinic light and also partially converts in-situ the non-photosensitive organic silver salt oxidizing agent present into silver halide which is undesirable as regards control over the gradation of the image as expressed by the dependence of optical density upon exposure to actinic light.

U.S. Pat. No. 5,028,523 discloses a photothermographic emulsion comprising silver halide, light-insensitive silver oxidizing compound, reducing agent for silver ion, and a binder, said emulsion also comprising a hydrobromic salt of a nitrogen-containing heterocyclic ring compound associated with a pair of bromine atoms. However, the hydrobromic salt of a nitrogen-containing heterocyclic ring compound associated with a pair of bromine atoms used in the invention example of U.S. Pat. No. 5,028,523, pyridinium hydrobromide perbromide, exhibits a high reactivity with silver behenate to form photosensitive silver bromide which, as is mentioned above, is undesirable as regards control over the gradation of the image as expressed by the dependence of optical density upon exposure to actinic light.

OBJECTS OF THE INVENTION

It is therefore a first object of the invention to provide a photothermographic material exhibiting a low fog level upon image-wise exposure and thermal development.

It is therefore a second object of the invention to provide a photothermographic material with low fog level and improved image-gradation, upon image-wise exposure and thermal development.

It is therefore further object of the invention to provide a photothermographic recording process utilizing a photothermographic material not necessitating preliminary heating before image-wise exposure.

Further objects and advantages of the invention will become apparent from the description hereinafter.

SUMMARY OF THE INVENTION

According to the present invention, an emulsion is provided comprising a substantially light-insensitive organic silver salt, photosensitive silver halide in catalytic association with the substantially light-insensitive organic silver salt and a binder, wherein the emulsion further comprises a polyhalide compound selected from the group consisting of quaternary ammonium polyhalides, quaternary phosphonium polyhalides and ternary sulphonium polyhalides, which satisfies a test specified in the description, or a product of a reaction between the polyhalide compound and a reducing species present in the emulsion.

According to the present invention a process is provided for producing a photothermographic recording material, capable of image formation without preliminary heating prior to exposure, comprising the step of producing a photo-addressable thermally developable element by coating an emulsion, as referred to above, on a support thereby forming an emulsion layer.

According to the present invention, a photothermographic recording material is also provided, capable of image formation without preliminary heating prior to exposure, comprising a photo-addressable thermally developable element comprising a substantially light-insensitive organic silver salt, photosensitive silver halide in catalytic association with the substantially light-insensitive organic silver salt, an organic reducing agent in thermal working relationship with the substantially light-insensitive organic silver salt and a binder, wherein the photo-addressable thermally developable element further comprises a polyhalide compound selected from the group consisting of quaternary ammonium polyhalides, quaternary phosphonium polyhalides and ternary sulphonium polyhalides, which satisfies a test specified in the description.

According to the present invention, a photothermographic recording process is also provided comprising the steps of: (i) image-wise exposing a photothermographic recording material, as referred to above, to a source of actinic radiation; and (ii) thermally developing the image-wise exposed photothermographic recording material.

Preferred embodiments of the invention are disclosed in the dependent claims.

DETAILED DESCRIPTION OF THE INVENTION

Quaternary Ammonium, Quaternary Phosphonium and Ternary Sulphonium Polyhalides According to the present invention, an emulsion is provided comprising a polyhalide compound selected from the group consisting of quaternary ammonium polyhalides, quaternary phosphonium polyhalides and ternary sulphonium polyhalides, which satisfies a test given below, or a product of a reaction between the polyhalide compound and a reducing species present in the emulsion.

The test which the polyhalide compounds used according to the present invention must satisfy is carried out as follows:

i) disperse silver behenate in deionized water by rapidly mixing with the anionic sulfonate dispersion agents, such as Ultravon™ W and Mersolat™ H80 paste, with quantities of water and dispersion agents to produce a predispersion containing 20% by weight of silver behenate and then homogenize with a microfluidizer to a finely divided and stable dispersion. Adjust the pH of the resulting dispersion to about 6.5;

ii) Add the following ingredients with stirring to 1.5 g of the silver behenate dispersion: 1 g of a 30% by weight concentration of a latex-copolymer, such as that obtained by copolymerizing methyl methacrylate, butadiene and itaconic acid in a weight ratio of 45:45:10, 0.013 g of succinimide, 0.1 g of a 11% by weight solution of saponin in a mixture of deionized water and methanol and an aqueous solution of a halogen compound capable of converting silver behenate into silver halide in a quantity corresponding to a concentration of 8 mol % with respect to the silver behenate present;

iii) Doctor-blade a subbed polyethylene terephthalate support having a thickness of 100 $\mu$m with the silver behenate/silver bromide dispersion at a blade setting of 60 $\mu$m. Dry for several minutes at 40° C. on the coating bed and then doctor blade the emulsion layer with a 2.44% by weight aqueous solution of the reducing agent 3-(3,4-dihydroxyphenyl)propionic acid at a blade setting of 30 $\mu$m. Allow the resulting thermographic material to dry on the coating bed for several minutes at 40° C. and then dry for 1 hour in a hot air oven at 50° C.;

iv) Expose the thermographic material to ultra-violet light in an Agfa-Gevaert™ DL 2000 exposure apparatus and then heat on a heated metal block for 10 s at 95° C.

In order to satisfy this test the optical density of the exposed and thermally developed material as measured with a densitometer, such as a MacBethm™ TR924 densitometer with a visible filter, must be less than 0.3.

An optical density of less than 0.3 indicates that little photosensitive silver halide is formed due to reaction between the compound being evaluated and silver behenate. However, the hydrobromic salts of nitrogen-containing heterocyclic ring compounds associated with a pair of bromine atoms, as disclosed in U.S. Pat. No. 5,028,523, did not satisfy this test, optical densities $\geqq 1.2$ being observed, which indicates the formation of a considerable quantity of photosensitive silver halide due to reaction between such compounds and silver behenate.

In a preferred embodiment of the present invention, the polyhalide compound is selected from the group of polyhalide compounds consisting of tetramethylammonium chloride perbromide, trimethylphenylammonium bromide perbromide and tetramethylammonium-bromide perbromide.

The quaternary ammonium, quaternary phosphonium and ternary sulphonium polyhalides, used according to the present invention, may be added as solids or solutions or may be formed in the dispersion of particles of the substantially light-insensitive silver salt by metathesis between a salt with polyhalide anions and onium salts with anions other than polyhalide.

Preferred polyhalide anions, used according to the present invention, consist of chlorine, bromine and iodine atoms.

The quaternary ammonium, quaternary phosphonium and ternary sulphonium polyhalides, used according to the present invention, may be polymeric or non-polymeric.

Suitable non-polymeric onium salts for use according to the present invention are the quaternary ammonium polyhalides (QAP's):

QAP01=tetramethylammonium chloride perbromide
QAP02=trimethylphenylammonium bromide perbromide
QAP03=tetramethylammonium bromide perbromide The quaternary ammonium, quaternary phosphonium and ternary sulphonium polyhalides, used according to the present invention, are preferably present in quantities of between 0.1 and 5.0 mol % with respect to the quantity of substantially light-insensitive organic silver salt of organic, with quantities between 0.4 and 2.4 mol % being particularly preferred.

Photo-addressable Thermally Developable Element

The photo-addressable thermally developable element, according to the present invention, comprises a substantially light-insensitive silver salt of a fatty acid, photosensitive silver halide in catalytic association therewith and an organic reducing agent in thermal working relationship with the substantially light-insensitive silver salt of a fatty acid and a binder. The element may comprise a layer system with the silver halide in catalytic association with the substantially light-insensitive organic silver salt ingredients, spectral sensitizer optionally together with a supersensitizer in intimate sensitizing association with the silver halide particles and the other ingredients active in the thermal development process or pre- or post-development stabilization of the element being in the same layer or in other layers with the proviso that the organic reducing agent and the toning agent, if present, are in thermal working relationship with the substantially light-insensitive organic silver salt i.e. during the thermal development process the reducing agent and the toning agent, if present, are able to diffuse to the substantially light-insensitive silver salt of a fatty acid.

Substantially Light-insensitive Organic Silver Salts

Preferred substantially light-insensitive organic silver salts used according to the present invention are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps"; silver dodecyl sulphonate described in U.S. Pat. No. 4,504,575; and silver di-(2-ethylhexyl)sulfosuccinate described in EP-A 227 141. Modified aliphatic carboxylic acids with thioether group as described e.g. in GB-P 1,111,492 and other organic silver salts as described in GB-P 1,439,478, e.g. silver benzoate and silver phthalazinone, may be used likewise to produce a thermally developable silver image. Further are mentioned silver imidazolates and the substantially light-insensitive inorganic or organic silver salt complexes described in U.S. Pat. No. 4,260,677.

Photosensitive Silver Halide

The photosensitive silver halide used in the present invention may be employed in a range of 0.75 to 25 mol percent and, preferably, from 2 to 20 mol percent of substantially light-insensitive organic silver salt.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium or iridium etc., a reducing agent such as a tin halide etc., or a combination thereof. The details of these procedures are described in T. H. James, "The Theory of the Photographic Process", Fourth Edition, Macmillan Publishing Co. Inc., New York (1977), Chapter 5, pages 149 to 169.

Emulsion of Organic Silver Salt and Photosensitive Silver Halide

A suspension of particles containing a substantially light-insensitive organic silver salt may be obtained by using a process, comprising simultaneous metered addition of a solution or suspension of an organic compound with at least one ionizable hydrogen atom or its salt; and a solution of a silver salt to a liquid, as described in EP-A 754 969.

The silver halide may be added to the photo-addressable thermally developable element in any fashion which places it in catalytic proximity to the substantially light-insensitive organic silver salt. Silver halide and the substantially light-insensitive organic silver salt which are separately formed, i.e. ex-situ or "preformed", in a binder can be mixed prior to use to prepare a coating solution, but it is also effective to blend both of them for a long period of time. Furthermore, it is effective to use a process which comprises adding a halogen-containing compound to the organic silver salt to partially convert the substantially light-insensitive organic silver salt to silver halide as disclosed in U.S. Pat. No. 3,457,075.

A particularly preferred mode of preparing the emulsion of organic silver salt and photosensitive silver halide, used according to the present invention is that disclosed in U.S. Pat. No. 3,839,049, but other methods such as those described in Research Disclosure, June 1978, item 17029 and U.S. Pat. No. 3,700,458 may also be used for producing the emulsion.

In a preferred embodiment of the present invention, the emulsion further comprises a reducing agent for silver ion.

Organic Reducing Agent for Photo-addressable Thermally Developable Elements Coated From Non-aqueous Media Suitable organic reducing agents for the reduction of the substantially light-insensitive organic heavy metal salts in photo-addressable thermally developable coated from non-aqueous media are organic compounds containing at least one active hydrogen atom linked to O, N or C, such as is the case with, mono-, bis-, tris- or tetrakis-phenols; mono- or bis-naphthols; di- or polyhydroxy-naphtalenes; di- or polyhydroxybenzenes; hydroxymonoethers such as alkoxynaphthols, e.g. 4-methoxy-1-naphthol described in U.S. Pat. No. 3,094,41; pyrazolidin-3-one type reducing agents, e.g. PHENIDONE (tradename); pyrazolin-5-ones; indan-1,3-dione derivatives; hydroxytetrone acids; hydroxytetronimides; 3-pyrazolines; pyrazolones; reducing saccharides; aminophenols e.g. METOL (tradename); p-phenylenediamines, hydroxylamine derivatives such as for example described in U.S. Pat. No. 4,082,901; reductones e.g. ascorbic acids; hydroxamic acids; hydrazine derivatives; amidoximes; n-hydroxyureas; and the like, see also U.S. Pat. Nos. 3,074,809, 3,080,254, 3,094,417 and 3,887,378.

Polyphenols such as the bisphenols used in the 3M Dry Silver™ materials, sulfonamide phenols such as used in the Kodak Dacomatic™ materials, and naphthols are particularly preferred for photothermographic recording materials with photo-addressable thermally developable elements on the basis of photosensitive silver halide/organic silver salt/reducing agent.

Organic Reducing Agent for Photo-Addressable Thermally Developable Elements Coated from Aqueous Media Suitable organic reducing agents for the reduction of the substantially light-insensitive organic heavy metal salts in photo-addressable thermally developable coated from aqueous media are organic compounds containing at least one active hydrogen atom linked to O, N or C. Particularly suitable organic reducing agents for the reduction of the substantially light-insensitive organic silver salt in such photo-addressable thermally developable elements are non-sulfo-substituted 6-membered aromatic or heteroaromatic ring compounds with at least three substituents one of which is a hydroxy group at a first carbon atom and a second of which is a hydroxy or amino-group substituted on a second carbon atom one, three or five ring atoms removed in a system of conjugated double bonds from the first carbon atom in the compound, in which (i) the third substituent may be part of an annelated carbocyclic or heterocyclic ring system; (ii) the third substituent or a further substituent is not an aryl- or oxo-aryl-group whose aryl group is substituted with hydroxy-, thiol- or amino-groups; and (iii) the third substituent or a further substituent is a non-sulfo-electron withdrawing group if the second substiuent is an amino-group.

In preferred reducing agents, the ring atoms of the non-sulfo-substitued 6-membered aromatic or heteroaromatic ring compound consist of nitrogen and carbon ring atoms and the non-sulfo-substituted 6-membered aromatic or heteroaromatic ring compound is annelated with an aromatic or heteroaromatic ring system.

In further preferred reducing agents, the non-sulfo-substituted 6-membered aromatic or heteroaromatic ring compound is substituted with one or more of the following substituents which may also be substituted: alkyl, alkoxy, carboxy, carboxy ester, thioether, alkyl carboxy, alkyl carboxy ester, aryl, sulfonyl alkyl, sulfonyl aryl, formyl, oxo-alkyl and oxo-aryl.

Particularly preferred reducing agents are substituted catechols or substitued hydroquinones with 3-(3',4'-dihydroxyphenyl)-propionic acid, 3',4'-dihydroxybutyrophenone, methyl gallate, ethyl gallate and 1,5-dihydroxy-naphthalene being especially preferred.

During the thermal development process the reducing agent must be present in such a way that it is able to diffuse to the substantially light-insensitive organic silver salt particles so that reduction of the substantially light-insensitive organic silver salt can take place.

Reducing Agent Incorporation

During the thermal development process the reducing agent must be present in such a way that it is able to diffuse to said substantially light-insensitive organic heavy metal salt particles so that reduction of said organic heavy metal salt can take place.

Molar Ratio of Reducing Agent:Organic Silver Salt

The silver image density depends on the coverage of the above defined reducing agent(s) and organic silver salt(s) and has to be preferably such that, on heating above 80° C., an optical density of at least 2.5 can be obtained. Preferably at least 0.10 moles of reducing agent per mole of organic heavy metal salt is used.

Auxiliary Reducing Agents

The above mentioned reducing agents, regarded as primary or main reducing agents, may be used in conjunction with so-called auxiliary reducing agents. Auxiliary reducing agents that may be used in conjunction with the above mentioned primary reducing agents are sulfonyl hydrazide reducing agents such as disclosed in U.S. Pat. No. 5,464,738, trityl hydrazides and formyl-phenyl-hydrazides such as disclosed in U.S. Pat. No. 5,496,695 and organic reducing metal salts, e.g. stannous stearate described in U.S. Pat. Nos. 3,460,946 and 3,547,648.

Spectral Sensitizer

The photo-addressable thermally developable element of the photothermographic recording material, used according to the present invention, may contain a spectral sensitizer, optionally together with a supersensitizer, for the silver halide. The silver halide may be spectrally sensitized with various known dyes including cyanine, merocyanine, styryl, hemicyanine, oxonol, hemioxonol and xanthene dyes optionally, particularly in the case of sensitization to infra-red radiation, in the presence of a so-called supersensitizer. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective. Suitable sensitizers of silver halide to infra-red radiation include those disclosed in the EP-A's 465 078, 559 101, 616 014 and 635 756, the JN's 03-080251, 03-163440, 05-019432, 05-072662 and 06-003763 and the U.S. Pat. Nos. 4,515,888, 4,639,414, 4,713,316, 5,258,282 and 5,441,866. Suitable supersensitizers for use with infra-red spectral sensitizers are disclosed in EP-A's 559 228 and 587 338 and in the U.S. Pat. Nos. 3,877,943 and 4,873,184.

Binder

The film-forming binder for the photo-addressable thermally developable element used according to the present invention may be coatable from a solvent or aqueous dispersion medium.

The film-forming binder for the photo-addressable thermally developable element used according to the present invention may be coatable from a solvent dispersion medium, used according to the present invention, may be all kinds of natural, modified natural or synthetic resins or mixtures of such resins, wherein the organic silver salt can be dispersed homogeneously: e.g. polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

The film-forming binder for the photo-addressable thermally developable element coatable from an aqueous dispersion medium, used according to the present invention, may be all kinds of transparent or translucent water-dispersible or water soluble natural, modified natural or synthetic resins or mixtures of such resins, wherein the organic silver salt can be dispersed homogeneously for example proteins, such as gelatin and gelatin derivatives (e.g. phthaloyl gelatin), cellulose derivatives, such as carboxymethylcellulose, polysaccharides, such as dextran, starch ethers etc., galactomannan, polyvinyl alcohol, polyvinylpyrrolidone, acrylamide polymers, homo- or co-polymerized acrylic or methacrylic acid, latexes of water dispersible polymers, with or without hydrophilic groups, or mixtures thereof. Polymers with hydrophilic functionality for forming an aqueous polymer dispersion (latex) are described e.g. in U.S. Pat. No. 5,006,451, but serve therein for forming a barrier layer preventing unwanted diffusion of vanadium pentoxide present as an antistatic agent.

Weight Ratio of Binder to Organic Silver Salt

The binder to organic heavy metal salt weight ratio is preferably in the range of 0.2 to 6, and the thickness of the photo-addressable thermally developable element is preferably in the range of 5 to 50 μm.

Thermal Solvents

The above mentioned binders or mixtures thereof may be used in conjunction with waxes or "heat solvents" also called "thermal solvents" or "thermosolvents" improving the reaction speed of the redox-reaction at elevated temperature.

By the term "heat solvent" in this invention is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the organic heavy metal salt, at a temperature above 60° C.

Toning Agent

In order to obtain a neutral black image tone in the higher densities and neutral grey in the lower densities the recording layer contains preferably in admixture with said organic heavy metal salts and reducing agents a so-called toning agent known from thermography or photo-thermography.

Suitable toning agents are succinimide and the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are the heterocyclic toner compounds of the benzoxazine dione or naphthoxazine dione type as described in GB-P 1,439,478, U.S. Pat. Nos. 3,951,660 and 5,599,647.

Antihalation Dyes

In addition to said ingredients, the photothermographic recording material of the present invention may contain antihalation or acutance dyes which absorb light which has passed through the photosensitive layer, thereby preventing its reflection. Such dyes may be incorporated into the photo-addressable thermally developable element or in any other layer comprising the photothermographic recording material of the present invention. The antihalation dye may also be bleached either thermally during the thermal development process, as disclosed in the U.S. Pat. Nos. 4,033,948, 4,088,497, 4,153,463, 4,196,002, 4,201,590, 4,271,263, 4,283,487, 4,308,379, 4,316,984, 4,336,323, 4,373,020, 4,548,896, 4,594,312, 4,977,070, 5,258,274, 5,314,795 and 5,312,721, or photo-bleached after removable after the thermal development process, as disclosed in the U.S. Pat. Nos. 3,984,248, 3,988,154, 3,988,156, 4,111,699 and 4,359,524. Furthermore the antihalation layer may be contained in a layer which can be removed subsequent to the exposure process, as disclosed in U.S. Pat. No. 4,477,562 and EP-A 491 457. Suitable antihalation dyes for use with infra-red light are described in the EP-A's 377 961 and 652 473, the EP-B's 101 646 and 102 781 and the U.S. Pat. Nos. 4,581,325 and 5,380,635.

Stabilizers and Antifoggants

In order to obtain improved shelf-life and reduced fogging, stabilizers and antifoggants may be incorporated into the thermographic and photothermographic materials of the present invention. Examples of suitable stabilizers and antifoggants and their precursors, which can be used alone or in combination, include the thiazolium salts described in U.S. Pat. Nos. 2,131,038 and 2,694,716; the azaindenes described in U.S. Pat. Nos. 2,886,437 and 2,444,605; the urazoles described in U.S. Pat. No. 3,287,135; the sulfocatechols described in U.S. Pat. No. 3,235,652; the oximes described in GB-P 623,448; the thiuronium salts described in U.S. Pat No. 3,220,839; the palladium, platinum and gold salts described in U.S. Pat. Nos. 2,566,263 and 2,597,915; the tetrazolyl-thio-compounds described in U.S. Pat. No. 3,700,457; the mesoionic 1,2,4-trizazolium-3-thiolate stablizer precursors described in U.S. Pat. Nos. 4,404,390 and 4,351,896; the tribromomethyl ketone compounds described in EP-A 600 587; the combination of isocyanate and halogenated compounds described in EP-A 600 586; the vinyl sulfone and β-halo sulfone compounds described in EP-A 600 589; and those compounds mentioned in this context in Chapter 9 of "Imaging Processes and Materials, Neblette's 8th edition", by D. Kloosterboer, edited by J. Sturge, V. Walworth and A. Shepp, page 279, Van Nostrand (1989); in Research Disclosure 17029 published in June 1978; and in the references cited in all these documents.

Other Additives

In addition to said ingredients the photo-addressable thermally developable element may contain other additives such as free fatty. acids, surface-active agents, antistatic agents, e.g. non-ionic antistatic agents including a fluorocarbon group as e.g. in $F_3C(CF_2)_6CONH(CH_2CH_2O)$—H, silicone oil, e.g. BAYSILONE Öl A (tradename of BAYER AG-GERMANY), ultraviolet light absorbing compounds, white light reflecting and/or ultraviolet radiation reflecting pigments, silica, colloidal silica, fine polymeric particles [e.g. of poly(methylmethacrylate)] and/or optical brightening agents.

Support

The support for the photothermographic recording material used according to the present invention may be transparent, translucent or opaque, e.g. having a white light reflecting aspect and is preferably a thin flexible carrier made e.g. from paper, polyethylene coated paper or transparent resin film, e.g. made of a cellulose ester, e.g. cellulose triacetate, corona and flame treated polypropylene, polystyrene, polymethacrylic acid ester, polycarbonate or polyester, e.g. polyethylene terephthalate or polyethylene naphthalate as disclosed in GB 1,293,676, GB 1,441,304 and GB 1,454,956. For example, a paper base substrate is present which may contain white reflecting pigments, optionally also applied in an interlayer between the recording material and said paper base substrate.

The support may be in sheet, ribbon or web form and subbed if need be to improve the adherence to the thereon coated thermosensitive recording layer. The support may be made of an opacified resin composition, e.g. polyethylene terephthalate opacified by means of pigments and/or microvoids and/or coated with an opaque pigment-binder layer, and may be called synthetic paper, or paperlike film; information about such supports can be found in EP's 194 106 and 234 563 and U.S. Pat. Nos. 3,944,699, 4,187,113, 4,780,402 and 5,059,579. Should a transparent base be used, said base may be colourless or coloured, e.g. having a blue colour.

One or more backing layers may be provided to control physical properties such as curl or static.

Protective Layer

According to a preferred embodiment of the photothermographic recording material of the present invention, the photo-addressable thermally developable element is provided with a protective layer to avoid local deformation of the photo-addressable thermally developable element, to improve its resistance against abrasion and to prevent its direct contact with components of the apparatus used for thermal development.

This protective layer may have the same composition as an anti-sticking coating or slipping layer which is applied in thermal dye transfer materials at the rear side of the dye donor material or protective layers used in materials for direct thermal recording.

The protective layer preferably comprises a binder, which may be solvent soluble (hydrophobic), solvent dispersible, water soluble (hydrophilic) or water dispersible. Among the hydrophobic binders polycarbonates as described in EP-A 614 769 are particularly preferred. Suitable hydrophilic binders are, for example, gelatin, polyvinylalcohol, cellulose derivatives or other polysaccharides, hydroxyethylcellulose, hydroxypropylcellulose etc., with hardenable binders being preferred and polyvinylalcohol being particularly preferred.

A protective layer used according to the present invention may be crosslinked. Crosslinking can be achieved by using crosslinking agents such as described in WO 95/12495 for protective layers, e.g. tetra-alkoxysilanes, polyisocyanates, zirconates, titanates, melamine resins etc., with tetraalkoxysilanes such as tetramethylorthosilicate and tetraethylorthosilicate being preferred.

A protective layer used according to the present invention may comprise in addition at least one solid lubricant having a melting point below 150° C. and at least one liquid lubricant in a binder, wherein at least one of the lubricants is a phosphoric acid derivative, further dissolved lubricating material and/or particulate material, e.g. talc particles, optionally protruding from the outermost layer. Examples of suitable lubricating materials are surface active agents, liquid lubricants, solid lubricants which do not melt during thermal development of the recording material, solid lubricants which melt (thermomeltable) during thermal development of the recording material or mixtures thereof. The lubricant may be applied with or without a polymeric binder.

Such protective layers may also comprise particulate material, e.g. talc particles, optionally protruding from the protective outermost layer as described in WO 94/11198. Other additives can also be incorporated in the protective layer e.g. colloidal particles such as colloidal silica.

Antistatic Layer

In a preferred embodiment the recording material of the present invention an antistatic layer is applied to the outermost layer not comprising at least one solid lubricant having a melting point below 150° C. and at least one liquid lubricant in a binder, wherein at least one of said lubricants is a phosphoric acid derivative. Suitable antistatic layers therefor are described in EP-A's 444 326, 534 006 and 644 456, U.S. Pat. Nos. 5,364,752 and 5,472,832 and DOS 4125758.

Coating

In a preferred embodiment of the present invention, the emulsion layer is overcoated with a layer comprising a polymer and said emulsion layer and/or said overcoat layer further comprise(s) an organic reducing agent in thermal working relationship with the substantially light-insensitive organic silver salt.

The coating of any layer of the recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Recording Process

Photothermographic materials, used according to the present invention, may be exposed with radiation of wavelength between an X-ray wavelength and a 5 microns wavelength with the image either being obtained by pixel-wise exposure with a finely focussed light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the object itself or an image therefrom with appropriate illumination e.g. with UV, visible or IR light.

For the thermal development of image-wise exposed photothermo-graphic recording materials, used according to the present invention, any sort of heat source can be used that enables the recording materials to be uniformly heated to the development temperature in a time acceptable for the application concerned e.g. contact heating, radiative heating, microwave heating etc.

A photothermographic recording process is further provided, according to the present invention, wherein subsequent to imagewise exposure no further heating is required to stabilize the image.

Applications

The photothermographic recording materials of the present invention can be used for both the production of transparencies and reflection type prints. This means that the support will be transparent or opaque, e.g. having a white light reflecting aspect. For example, a paper base substrate is present which may contain white reflecting pigments, optionally also applied in an interlayer between the recording material and said paper base substrate. Should a transparent base be used, said base may be colourless or coloured, e.g. has a blue colour.

In the hard copy field photothermographic recording materials on a white opaque base are used, whereas in the medical diagnostic field black-imaged transparencies are widely used in inspection techniques operating with a light box.

While the present invention will hereinafter be described in connection with a preferred embodiment thereof, it will be understood that it is not intended to limit the invention to that embodiment. On the contrary, it is intended to cover all alternatives, modifications and equivalents as may be included in the spirit and scope of the invention as defined by the appending claims.

The following ingredients in addition to those mentioned above were used in the photothermographic recording materials of the invention examples and comparative examples illustrating the present invention in the antistatic layer:

KELZAN™ S: a xanthan gum from MERCK & CO., Kelco Division, USA, which according to Technical Bulletin DB-19 is a polysaccharide containing mannose, glucose and glucuronic repeating units as a mixed potassium, sodium and calcium salt;

PT-dispersion: a dispersion of poly(3,4-ethylenedioxythiophene)/ploystyrene sulphonic acid produced by. the polymerization of 3,4-ethylenedioxy-thiophene in the presence of polystyrene sulphonic acid and ferric sulphate as described in U.S. Pat. No. 5,354,613;

ULTRAVON™ W: an aryl sulfonate from CIBA-GEIGY;

PERAPRET™ PE40: a 40% aqueous dispersion of polyethylene wax from BASF;

KIESELSOL™ 100F: a 36% aqueous dispersion of colloidal silica from BAYER;

MAT01: 20% aqueous dispersion of particles of methylmethacrylate(98% by weight)-stearylmethacrylate(2% by weight)-copolymeric beads with an average particle size of 5.9 $\mu$m produced as described in U.S. Pat No. 4,861,812;

LATEX01: a 12% by weight dispersion of polymethyl methacrylate with an average particle size of 88.8 nm prepared as described in U.S. Pat. No. 5,354,613;

D01:

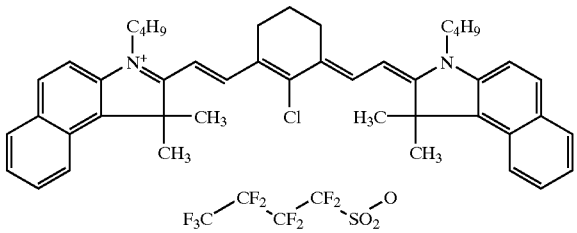

in the photo-addressable thermally developable element:

GEL: phthaloylgelatin, type 16875 from ROUSSELOT;

PHP: pyridinium hydrobromide perbromide;

Butvar™ B76: polyvinylbutyral from MONSANTO;

SENSI:

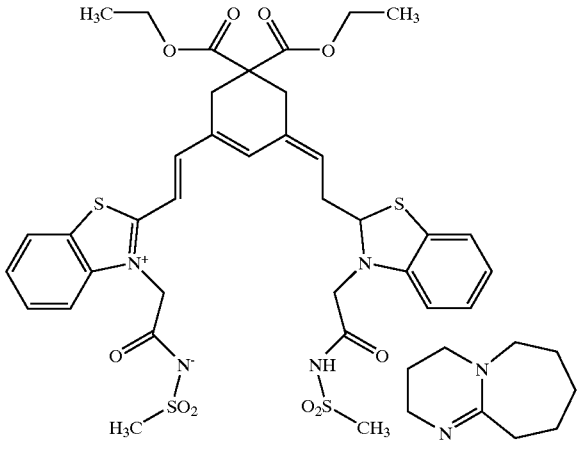

LOWINOX™ 22IB46: 2-propyl-bis(2-hydroxy-3,5-dimethylphenyl)methane from CHEM. WERKE LOWI;

TMPS: tribromomethyl benzenesulfinate;

and in the protective layer:

CAB: cellulose acetate butyrate, CAB-171-15S from EASTMAN;

PMMA: polymethylmethacrylate, Acryloid™ K120N from ROHM & HAAS;

LOWINOX™ 22IB46: 2-propyl-bis(2-hydroxy-3,5-dimethylphenyl)methane from CHEM. WERKE LOWI.

The invention is illustrated hereinafter by way of INVENTION EXAMPLES and COMPARATIVE EXAMPLES. The percentages given in these examples are by weight unless otherwise indicated.

INVENTION EXAMPLE 1 AND COMPARATIVE EXAMPLE 1

Comparison between stabilization behaviour of tetramethylammonium bromide perbromide (QAP 03), used according to the present invention, and that of tetramethylammonium bromide, according to GB-P 1 342 525:

Support

A polyethyleneterephthalate (PET) foil was first coated on both sides with a subbing layer consisting of a terpolymer latex of vinylidene chloride-methyl acrylate-itaconic acid (88/10/2) in admixture with colloidal silica (surface area 100 $m^2/g$). After stretching the foil in the transverse direction the foil had a thickness of 175 $\mu$m with coverages of the terpolymer and of the silica in the subbing layers of 170 $mg/m^2$ and 40 $mg/m^2$ respectively on each side of the PET-foil.

Antihalation/antistatic Layer

The antihalation/antistatic layers of the photothermographic recording materials of INVENTION EXAMPLE 1 and COMPARATIVE EXAMPLE 1 were prepared by first adsorbing antihalation dye D01 onto the polymethyl methacrylate particles of LATEX01 by adding 55 mg of D01 dissolved in ethyl acetate/g polymethyl methacrylate and then evaporating off the ethyl acetate.

One side of the thus subbed PET-foil was then coated with an antistatic composition consisting obtained by dissolving 0.30 g of KELZAN™ S in a stirred mixture of 22.4 mL of N-methylpyrrolidone, 0.84 g of ULTRAVON™ W, 1 g of PERAPRET™ PE40 and 2.22 g of KIESELSOL 100F in 74.3 mL of deionized water and then adding with stirring: 0.2 mL of 25% $NH_4OH$, 0.6 g of dried PT-dispersion, 66.7 mL of LATEX01 after adsorption of D01, 1.2 mL of MAT01 and 30 mL of 2-propanol to produce a layer after drying at 120° C. consisting of:

| | |
|---|---|
| KELZAN ™ S: | 7.5 mg/m$^2$ |
| Dried PT-dispersion: | 15 mg/m$^2$ |
| ULTRAVON ™ W: | 21 mg/m$^2$ |
| polyethylene wax (from PERAPRET ™ PE40): | 10 mg/m$^2$ |
| colloidal silica (from KIESELSOL ™ 100F): | 20 mg/m$^2$ |
| 5.9 μm beads of methylmethacrylate-stearyl-methacrylate copolymer (from MAT01): | 6 mg/m$^2$ |
| polymethylmethacrylate (from LATEX01): | 200 mg/m$^2$ |
| Antihalation dye D01: | 11 mg/m$^2$ |

Silver Halide Emulsion

An silver halide emulsion consisting of 3.11% by weight of silver halide particles consisting of 97 mol % silver bromide and 3 mol % silver iodide with an weight average particle size of 50 nm, 0.47% by weight of GEL as dispersing agent in deionized water was prepared using conventional silver halide preparation techniques such as described, for example, in T. H. James, "The Theory of the Photographic Process", Fourth Edition, Macmillan Publishing Co. Inc., New York (1977), Chapter 3, pages 88–104.

Silver Behenate/silver Halide Emulsion

The silver behenate/silver halide emulsion was prepared by adding a solution of 6.8 kg of behenic acid in 67 L of 2-propanol at 65° C. to a 400 L vessel heated to maintain the temperature of the contents at 65° C., converting 96% of the behenic acid to sodium behenate by adding with stirring 76.8 L of 0.25M sodium hydroxide in deionized water, then adding with stirring 10.5 kg of the above-described silver halide emulsion at 40° C. and finally adding with stirring 48 L of a 0.4M solution of silver nitrate in deionized water. Upon completion of the addition of silver nitrate the contents of the vessel were allowed to cool and the precipitate filtered off, washed, slurried with water, filtered again and finally dried at 40° C. for 72 hours.

7 kg of the dried powder containing 9 mol % silver halide and 4 mol % behenic acid with respect to silver behenate were then dispersed in a solution of 700 g of Butvar™ B76 in 15.6 kg of 2-butanone using convention dispersion techniques yielding a 33% by weight dispersion. 7.4 kg of 2-butanone were then added with stirring and the resulting dispersion homogenized in a microfluidizer. Finally 2.8 kg of Butvar™ B76 were added with stirring to produce a dispersion with 31% by weight of solids.

Coating and Drying of Silver Behenate/silver Halide Emulsion Layer

Coating compositions for the emulsion layers of the photothermo-graphic recording materials of INVENTION EXAMPLE 1 and COMPARATIVE EXAMPLE 1 were prepared by adding the following solutions or liquids to 40.86 g of the above-mentioned silver behenate/silver halide emulsion in the following sequence with stirring: 6.87 g of 2-butanone, 0.95 g of a 9% solution of QAP 03 or 2.34 g of a 0.77% solution of tetramethylammonium bromide in methanol followed by 2 hours stirring, 0.2 g of a 11% solution of calcium bromide in methanol and 1.39 of 2-butanone followed by 30 minutes stirring, a solution consisting of 0.21 g of LOWINOX™ 22IB46, 0.5 g of TMPS and 9.24 g of 2-butanone followed by 15 minutes stirring, 1.8 g of a 0.11% solution of SENSI in methanol followed by 30 minutes stirring and finally 4.35 g of Butvar™ B76 followed by 45 minutes stirring.

A coating composition for the emulsion layer of the photothermographic recording material of COMPARATIVE EXAMPLE 1 was prepared as for that for the emulsion layer of the photothermographic recording material of INVENTION EXAMPLE 1 except that QAP01 was omitted from the coating composition.

The side of the PET-foil not coated with the antistatic layer was then doctor blade-coated at a blade setting of 100 μm with the coating composition for the emulsion layers of the photothermo-graphic recording materials of INVENTION EXAMPLE 1 and COMPARATIVE EXAMPLE 1 respectively to a wet layer thickness of 75 μm, which after drying for 5 minutes at 80° C. on an aluminium plate in a drying cupboard produced a layers with the following compositions:

| | INVENTION EXAMPLE 1 | COMPARATIVE EXAMPLE 1 |
|---|---|---|
| Butvar ™ B76 | 8.70 g/m$^2$ | 8.70 g/m$^2$ |
| GEL | 0.045 g/m$^2$ | 0.045 g/m$^2$ |
| $AgBr_{0.97}I_{0.03}$ | 0.301 g/m$^2$ | 0.301 g/m$^2$ |
| silver behenate | 7.929 g/m$^2$ | 7.929 g/m$^2$ |
| QAP03 | 0.0855 g/m$^2$ (15.2 mmol/mol silver behenate) | — |
| $(CH_3)_4NBr$ | — | 0.0181 g/m$^2$ (6.54 mmol/mol silver behenate) |
| calcium bromide | 0.022 g/m$^2$ | 0.022 g/m$^2$ |
| LOWINOX ™ 22IB46 | 0.210 g/m$^2$ | 0.210 g/m$^2$ |
| SENSI | 0.002 g/m$^2$ | 0.002 g/m$^2$ |
| TMPS | 0.500 g/m$^2$ | 0.500 g/m$^2$ |

Protective Layer

A protective layer coating composition for the photothermographic recording materials of INVENTION EXAMPLE 1 and COMPARATIVE EXAMPLE 1 was prepared by dissolving 4.08 g of CAB and 0.16 g of PMMA in 56.06 g of 2-butanone and 5.2 g of methanol and adding the following solutions or liquids with stirring in the following sequence: 0.5 g of phthalazine, 0.2 g of 4-methylphthalic acid, 0.1 g of tetrachlorophthalic acid, 0.2 g of tetrachlorophthalic acid anhydride and a solution consisting of 2.55 g of LOWINOX™ 22IB46 and 5.95 g of 2-butanone.

The emulsion layers of INVENTION EXAMPLE 1 and COMPARATIVE EXAMPLE 1 were then doctor blade-coated at a blade setting of 100 μm with a protective layer composition to a wet layer thickness of 80 μm, which after drying for 8 minutes at 80° C. on an aluminium plate in a drying cupboard produced a layer with the following composition:

| | |
|---|---|
| PMMA | 0.16 g/m$^2$ |
| CAB | 4.08 g/m$^2$ |
| Phthalazine | 0.50 g/m$^2$ |

-continued

| | |
|---|---|
| 4-methylphthalic acid | 0.20 g/m$^2$ |
| tetrachlorophthalic acid anhydride | 0.20 g/m$^2$ |
| tetrachlorophthalic acid | 0.10 g/m$^2$ |
| LOWINOX ™ 22IB46 | 2.55 g/m$^2$ |

Image-wise Exposure and Thermal Processing

The photothermographic recording materials of INVENTION EXAMPLE 1 and COMPARATIVE EXAMPLE 1 were exposed to a 849 nm single mode diode laser beam from SPECTRA DIODE LABS with a nominal power of 100 mW of which 61 mW actually reaches the recording material focussed to give a spot diameter (1/e$^2$) of 28 $\mu$m, scanned at speed of 50 m/s with a pitch of 14 $\mu$m through a wedge filter with optical density varying between 4.2 and 0 in optical density steps of 0.20.

Thermal processing was carried out for 10 s on a drum heated to a temperature of 121° C. with the side of the photothermographic recording material on which the photoaddressable thermally developable element had been coated in contact with the drum. The optical density variation of the resulting wedge images was evaluated with a MACBETH™ TR924 densitometer with a visual filter to produce a sensitometric curve for the photothermographic recording materials. The $D_{max}$- and $D_{min}$-values obtained are summarized in table 1.

TABLE 1

| Comparative example number | Antifoggant present | Antifoggant concentration mmol/mol silver behenate | image characteristics $D_{max}$ | $D_{min}$ |
|---|---|---|---|---|
| 1 | $(CH_3)_4NBr$ | 6.54 | 3.20 | 2.60 |
| Invention example number | | | | |
| 1 | QAP03 | 15.20 | 2.97 | 0.13 |

The results in table 1 show that tetramethylammonium bromide, which according to GB-P 1 342 525 exhibits both speed-increasing and stabilizing properties does not stabilize the photothermographic material, whereas tetramethylammonium bromide perbromide, used according to the present invention, exhibits excellent stabilizing properties as evidenced by the very low $D_{min}$-value obtained.

INVENTION EXAMPLES 2 TO 4 AND COMPARATIVE EXAMPLE 2

Testing the Ability of Onium Polyhalides to React with Silver Behenate to Form Photosensitive Silver Halide The tests were carried out as described above. Table 2 summarizes the results obtained with three quaternary ammonium compounds, QAP01, QAP02 and QAP03, and pyridinium hydrobromide perbromide (PHP), as disclosed in U.S. Pat. No. 5,028,523.

TABLE 2

| Invention | Onium polyhalide Compound(s) used | mol % vs. AgBeh | Test result |
|---|---|---|---|
| Example number | | | |
| 2 | QAP01 | 8 | passed |
| 3 | QAP02 | 8 | passed |
| 4 | QAP03 | 8 | passed |
| Comparative Example number | | | |
| 2 | PHP | 8 | failed |

It is clear that pyridinium hydrobromide perbromide, as disclosed in U.S. Pat. No. 5,028,523, has a very strong reactivity with silver behenate to form photosensitive silver bromide. Therefore the pyridinium hydrobromide perbromide present is only partly available for stabilization. Furthermore, the additional silver halide formed may have a particle size which considerably differs from that of the photosensitive silver halide already present, which may have an undesirable influence on the gradation of the image of a photothermographic material.

QAP01, QAP02 and QAP03 of the present invention, on the other hand, exhibit a low reactivity with silver behenate to form photosensitive silver halide and therefore will be completely available for stabilization. Furthermore, since little photosensitive silver halide is formed, little or no influence on the gradation of the image of a photothermographic material will be observed.

INVENTION EXAMPLE 5 AND COMPARATIVE EXAMPLE 3

Silver Behenate/silver Halide Emulsion

The 245.0 g of the silver behenatel silver behenate powder prepared as described for INVENTION EXAMPLE 1 containing 9 mol % silver halide and 4 mol % behenic acid with respect to silver behenate were then dispersed in a solution of 122.5 g of Butvar™ B76 in 1 L of 2-butanone using convention dispersion techniques yielding a dispersion with 31.4% by weight of solids.

Coating and Drying of Silver Behenate/silver Halide Emulsion Layer

A coating composition for the emulsion layer of the photothermographic recording material of INVENTION EXAMPLE 5 was prepared by adding the following solutions or liquids to 53.6 g of the above-mentioned silver behenate/silver halide emulsion in the following sequence with stirring: 8.2 g of 2-butanone, 1.5 g of a 9% solution of QAP01 in methanol followed by 2 hours stirring, 0.2 g of a 11% solution of calcium bromide in methanol followed by 30 minutes stirring, 1 g of 2-butanone, 1.8 g of a 0.1% solution of SENSI in methanol followed by 30 minutes stirring, 2 g of methanol, 2.4 g of LOWINOX™ 22IB46 followed by 15 minutes stirring and 0.5 g of TMPS followed by 15 minutes stirring.

A coating composition for the emulsion layer of the photothermographic recording material of COMPARATIVE EXAMPLE 3 was prepared as for that for the emulsion layer of the photothermographic recording material of INVEN- TION EXAMPLE 5 except that the solution of QAP01 was omitted from the coating composition and substituted with 1.5 g of methanol.

The side of the PET-foil not coated with the antistatic layer was then doctor blade-coated at a blade setting of 100 μm with the coating composition for the emulsion layers of the photothermographic recording materials of INVENTION EXAMPLE 5 and COMPARATIVE EXAMPLE 3 respectively to a wet layer thickness of 75 μm, which after drying for 5 minutes at 80° C. on an aluminium plate in a drying cupboard produced a layers with the following compositions:

| | INVENTION EXAMPLE 5 | COMPARATIVE EXAMPLE 3 |
|---|---|---|
| Butvar ™ B76 | 8.70 g/m$^2$ | 8.70 g/m$^2$ |
| GEL | 0.045 g/m$^2$ | 0.045 g/m$^2$ |
| $AgBr_{0.97}I_{0.03}$ | 0.301 g/m$^2$ | 0.301 g/m$^2$ |
| silver behenate | 7.929 g/m$^2$ | 7.929 g/m$^2$ |
| behenic acid | 0.316 g/m$^2$ | 0.316 g/m$^2$ |
| QAP01 | 0.138 g/m$^2$ (29 mmol/mol silver behenate) | — |
| calcium bromide | 0.022 g/m$^2$ | 0.022 g/m$^2$ |
| LOWINOX ™ 22IB46 | 2.400 g/m$^2$ | 2.400 g/m$^2$ |
| SENSI | 0.002 g/m$^2$ | 0.002 g/m$^2$ |
| TMPS | 0.500 g/m$^2$ | 0.500 g/m$^2$ |

Protective Layer

A protective layer coating composition for the photothermographic recording materials of INVENTION EXAMPLE 5 and COMPARATIVE EXAMPLE 3 was prepared by dissolving 4.08 g of CAB and 0.16 g of PMMA in 44.9 g of 2-butanone and 4.16 g of methanol and adding the following solutions or liquids with stirring in the following sequence: 0.5 g of phthalazine, 0.2 g of 4-methylphthalic acid and 0.2 g of tetrachlorophthalic acid anhydride.

The emulsion layers of INVENTION EXAMPLE 5 and COMPARATIVE EXAMPLE 3 were then doctor blade-coated at a blade setting of 100 μm with a protective layer composition to a wet layer thickness of 57 μm, which after drying for 8 minutes at 80° C. on an aluminium plate in a drying cupboard produced a layer with the following composition:

| | |
|---|---|
| PMMA | 0.16 g/m$^2$ |
| CAB | 4.08 g/m$^2$ |
| Phthalazine | 0.50 g/m$^2$ |
| 4-methylphthalic acid | 0.20 g/m$^2$ |
| tetrachlorophthalic acid anhydride | 0.20 g/m$^2$ |

Image-wise Exposure and Thermal Processing

The photothermographic recording materials of INVENTION EXAMPLE 5 and COMPARATIVE EXAMPLE 3 were exposed to an EG&G lamp through a L775-filter and a wedge filter with optical densities varying between 0 and 3.0 in steps of 0.15 for 30 s.

Thermal processing was carried out for 10 s with the side of the support coated with the silver behenate/silver halide and the protective layer in contact with a drum heated to a temperature of 118° C. The optical densities of the resulting wedge images were evaluated with a MACBETH™ TD904 densitometer with a blue filter to produce a sensitometric curve for the photothermographic materials. The $D_{max}$- and $D_{min}$-values obtained are summarized in table 3 below.

TABLE 3

| Comparative | Antifoggant present | Antifoggant concentration mmol/mol silver behenate | image characteristics $D_{max}$ | $D_{min}$ |
|---|---|---|---|---|
| example number | | | | |
| 2 | — | — | 3.5 | 3.0 |
| Invention example number | | | | |
| 4 | QAP01 | 29 | 3.1 | 0.17 |

From these results it is clear that the incorporation of QAP01 in the emulsion layer of photothermographic materials considerably reduces their $D_{min}$-value thereby demonstrating antifoggant behaviour.

INVENTION EXAMPLE 6

Silver Behenate/silver Halide Emulsion

The 245.0 g of the silver behenate/silver behenate powder prepared as described in INVENTION EXAMPLE 1 containing 9 mol % silver halide and 4 mol % behenic acid with respect to silver behenate were then dispersed in a solution of 122.5 g of Butvar™ B76 in 1 L of 2-butanone using convention dispersion techniques yielding a 31.3% by weight dispersion.

Coating and Drying of Silver Behenate/silver Halide Emulsion Layer

An emulsion layer coating composition for the photothermographic recording material of INVENTION EXAMPLE 6 was prepared by adding the following solutions or liquids to 40.9 g of the above-mentioned silver behenate/silver halide emulsion in the following sequence with stirring: 12.2 g of 2-butanone, 0.43 g of a 9% solution of QAP01 in methanol followed by a 2 hours stirring, 0.2 g of a 11% solution of calcium bromide in methanol, 1.3 g of 2-butanone followed by 30 minutes stirring, 0.7 g of a 30% solution of LOWINOX™ 22IB46 in 2-butanone, 9.25 g of a 5.4% solution of TMPS in 2-butanone followed by 15 minutes stirring, 1.8 g of a 0.1% solution of SENSI in 2-butanone followed by 30 minutes stirring and finally 4.35 g of Butvar™ B76.

The PET-foil subbed and coated with an antistatic layer as described in INVENTION EXAMPLE 1, was then doctor blade-coated at a blade setting of 150 μm on the side of the foil not coated with an antistatic layer with the coating composition to a wet layer thickness of 85 μm, which after drying for 5 minutes at 80° C. on an aluminium plate in a drying cupboard produced a layer with the following composition:

| | |
|---|---|
| Butvar ™ B76 | 8.49 g/m$^2$ |
| GEL | 0.044 g/m$^2$ |
| $AgBr_{0.97}I_{0.03}$ | 0.295 g/m$^2$ |

-continued

| | | |
|---|---|---|
| silver behenate | 7.733 g/m$^2$ | |
| behenic acid | 0.308 g/m$^2$ | |
| QAP01 | 0.038 g/m$^2$ | (8.18 mmol/mol silver behenate) |
| calcium bromide | 0.021 /m$^2$ | |
| LOWINOX ™ 22IB46 | 0.205 /m$^2$ | |
| SENSI | 0.002 g/m$^2$ | |
| TMPS | 0.488 g/m$^2$ | |

Protective Layer

A protective layer coating composition for the photothermographic recording material of INVENTION EXAMPLE 6 was prepared by dissolving 4.16 g of CAB and 0.16 g of PMMA in 36.3 g of 2-butanone and 4.16 g of methanol and adding the following solutions or liquids with stirring in the following sequence: 0.5 g of phthalazine, 0.2 g of 4-methylphthalic acid, 0.1 g of tetrachlorophthalic acid, 0.2 g of tetrachlorophthalic acid anhydride and 8.5 g of a 30% solution of LOWINOX™ 22IB46 in 2-butanone.

The emulsion layer was then doctor blade-coated at a blade setting of 100 $\mu$m with the protective layer coating composition to a wet layer thickness of 57 $\mu$m, which after drying for 8 minutes at 80° C. on an aluminium plate in a drying cupboard produced a layer with the following composition:

| | |
|---|---|
| CAB | 4.08 g/m$^2$ |
| PMMA | 0.16 g/m$^2$ |
| Phthalazine | 0.50 g/m$^2$ |
| 4-methylphthalic acid | 0.20 g/m$^2$ |
| tetrachlorophthalic acid | 0.10 g/m$^2$ |
| tetrachlorophthalic acid anhydride | 0.20 g/m$^2$ |
| LOWINOX ™ 22IB46 | 2.55 g/m$^2$ |

Image-wise Exposure and Thermal processing

The photothermographic recording material of INVENTION EXAMPLE 6 was image-wise exposed, thermally processed and the images evaluated as described for INVENTION EXAMPLE 1 to yield a $D_{max}$-value of 3.54 and a $D_{min}$-value of 0.10.

INVENTION EXAMPLES 7 TO 10 AND COMPARATIVE EXAMPLE 4

The photothermographic recording materials of INVENTION EXAMPLES 7 to 10 and COMPARATIVE EXAMPLE 4 were produced as described for INVENTION EXAMPLE 6 except that in the materials of INVENTION EXAMPLES 7, 8 and 9 the QAP01 concentrations used in the emulsion layer were 4.09 mmol/mol silver behenate, 16.36 mmol/mol silver behenate and 24.54 mmol/mol silver behenate respectively, in the materials of INVENTION EXAMPLE 10 16.0 mmol/mol silver behenate of QAP02 was substituted for QAP01 in the emulsion layer and in the material of COMPARATIVE EXAMPLE 4 QAP01 was omitted from the emulsion layer.

The photothermographic recording materials of INVENTION EXAMPLES 7 to 10 and COMPARATIVE EXAMPLE 4 were image-wise exposed, thermally processed and the images evaluated as described for INVENTION EXAMPLE 1. The $D_{max}$- and $D_{min}$-values obtained together with those obtained with the photothermographic recording material of INVENTION EXAMPLE 6 are summarized in table 4 below.

TABLE 4

| Comparative | Antifoggant present | Antifoggant concentration mmol/mol silver behenate | image characteristics $D_{max}$ | $D_{min}$ |
|---|---|---|---|---|
| example number | | | | |
| 4 | — | — | 3.44 | 0.9 |
| Invention example number | | | | |
| 7 | QAP01 | 4.09 | 3.80 | 0.12 |
| 6 | QAP01 | 8.18 | 3.54 | 0.10 |
| 8 | QAP01 | 16.36 | 3.33 | 0.11 |
| 9 | QAP01 | 24.54 | 3.70 | 0.12 |
| 10 | QAP02 | 16.0 | 3.30 | 0.13 |

From these results it is clear that the incorporation of QAP01 and QAP02 in the emulsion layer of photothermographic materials, used according to the present invention, considerably reduces their $D_{min}$-value thereby demonstrating antifoggant behaviour in such onium polyhalides.

Having described in detail preferred embodiments of the current invention, it will now be apparent to those skilled in the art that numerous modifications can be made therein without departing from the scope of the invention as defined in the following claims.

What is claimed is:

1. An emulsion comprising a substantially light-insensitive organic silver salt, a photosensitive silver halide in catalytic association with said substantially light-insensitive organic silver salt, a binder, and a polyhalide compound selected from the group consisting of quaternary ammonium polyhalides, quaternary phosphonium polyhalides and ternary sulphonium polyhalides, wherein said polyhalide compound satisfies a test having the following steps:

(i) preparing a silver behenate dispersion in deionized water by rapidly mixing with anionic sulfonate dispersion agents to produce a predispersion containing 20% by weight of silver behenate, homogenizing to a finely divided and stable dispersion, and then adjusting the pH to about 6.5;

(ii) adding to 1.5 g of the silver behenate dispersion of (i) with stirring: 1 g of a 30% by weight dispersion of a latex-copolymer, 0.1 g of a 11% by weight solution of saponin in a mixture of deionized water and methanol and an aqueous solution of said polyhalide compound in a quantity corresponding to a concentration of 8 mol % with respect to the silver behenate present to produce silver behenate/silver halide dispersion;

(iii) coating said silver behenate/silver halide dispersion of (ii) on a subbed polyethylene terephthalate support, drying said coating, then overcoating with a 2.44% by weight aqueous solution of 3-(3,4-dihydroxyphenyl)-propionic acid and drying to produce a test thermographic material;

(iv) exposing said test thermographic material of (iii) to ultraviolet light in an Agfa-Gevaert™ DL2000 exposure apparatus and heating on a metal block for 10 s at 95° C.; and (v) measuring the optical density of the exposed and thermally developed test material with a densitometer with a visible filter, wherein the developed test thermographic material has an optical density of less than 0.3.

2. The emulsion according to claim 1, wherein said polyhalide compound is present in said emulsion in quantities of between 0.1 and 5.0 mol % with respect to the quantity of said substantially light-insensitive organic silver salt.

3. The emulsion according to claim 1, wherein said emulsion further comprises a compound having an absorption maximum in the wavelength range of 600 to 1100 nm.

4. The emulsion according to claim 1, wherein said substantially light-insensitive organic silver salt is a silver salt of an aliphatic carboxylic acid.

5. The emulsion according to claim 1, wherein said emulsion further comprises a reducing agent for silver ion.

6. The emulsion of claim 1, wherein the quaternary ammonium, quaternary phosphonium and tertiary polyhalide is formed in a dispersion of particles of the substantially light-insensitive silver salt by metathesis between a salt with a polyhalide anion and an onium salt with an anion other than polyhalide.

7. A process for producing a photothermographic recording material capable of image formation without preliminary heating prior to exposure, the process comprising: producing a photo-addressable thermally developable element by (A) mixing into the emulsion obtained according to claim 1 an organic reducing agent for said substantially light-insensitive organic silver salt;

(B) coating the emulsion obtained from (A) onto a support; and (C) drying the coating obtained in (B) to form an emulsion layer on top of the support.

8. The process according to claim 7, wherein said emulsion layer is overcoated with an overcoat layer comprising a polymer and an organic reducing agent in thermal working relationship with said substantially light-insensitive organic silver salt layer.

9. A photothermographic recording process comprising:

(a) image-wise exposing a photothermographic recording material obtained from the process according to claims 7 or 8 to a source of actinic radiation; and (b) thermally developing the image-wise exposed photothermographic recording material.

10. The process according to claim 9, further comprising coating said emulsion layer with said overcoat layer and a second emulsion layer comprising the components of said emulsion layer.

11. The process according to claim 9, wherein said overcoat layer further comprises a binder and an organic reducing agent in thermal working relationship with said substantially light-insensitive organic silver salt.

12. The process of claim 7 or 9, wherein the quaternary ammonium, quaternary phosphonium and ternary sulphonium may be formed in a dispersion of particles of the substantially light-insensitive silver salt by metathesis between a salt with a polyhalide anion and an onium salt with an anion other than polyhalide.

13. A process for producing a photothermographic recording material capable of image formation without preliminary heating prior to exposure, the process comprising: producing a photo-addressable thermally developable element by (A) coating the emulsion obtained according to claim 1 onto a support to form an emulsion layer;

(B) drying said emulsion layer;

(C) coating said dried first emulsion layer with an overcoat layer comprising a binder and an organic reducing agent for said substantially light-insensitive organic silvers salt in said first emulsion layer; and (D) drying said overcoat layer.

14. A photothermographic material, capable of image formation without preliminary heating prior to exposure, comprising a photo-addressable thermally developable element comprising a substantially light-insensitive organic silver salt, an organic reducing agent in thermal working relationship therewith, a photosensitive silver halide in catalytic association with said substantially light-insensitive organic silver salt, a binder, and a polyhalide compound selected from the group consisting of quaternary ammonium polyhalides, quaternary phosphonium polyhalides and ternary sulphonium polyhalides, wherein said polyhalide compound satisfies a test having the following steps:

(i) preparing a silver behenate dispersion in deionized water by rapidly mixing with anionic sulfonate dispersion agents to produce a predispersion containing 20% by weight of silver behenate, homogenizing to a finely divided and stable dispersion and then adjusting the pH to about 6.5;

(ii) adding to 1.5 g of the silver behenate dispersion of (i) with stirring: 1 g of a 30% by weight dispersion of a latex-copolymer, 0.1 g of a 11% by weight solution of saponin in a mixture of deionized water and methanol and an aqueous solution of said polyhalide compound in a quantity corresponding to a concentration of 8 mol % with respect to the silver behenate present to produce a silver behenate/silver halide dispersion;

(iii) coating said silver behenate/silver halide dispersion of (ii) on a subbed polyethylene terephthalate support, drying said coating, then overcoating with a 2.44% by weight aqueous solution of 3-(3,4-dihydroxyphenyl)-propionic acid and drying to produce a test thermographic material;

(iv) exposing said test thermographic material of (iii) to ultraviolet light in an Agfa-Gevaert™ DL2000 exposure apparatus and heating on a metal block for 10 s at 95° C.; and (v) measuring the optical density of the exposure and thermally developed test material with a densitometer with a visible filter, wherein the developed test thermographic material has an optical density of less than 0.3.

15. The photothermographic recording material according to claim 14, wherein said photo-addressable thermally developable element is provided with a protective layer.

16. The photothermographic material of claim 14, wherein the quaternary ammonium, quaternary phosphonium and ternary sulphonium are formed in a dispersion of particles of the substantially light-insensitive silver salt by metathesis between a salt with a polyhalide anion and an onium salt with an anion other than polyhalide.

17. A photothermographic recording process comprising:

(a) image-wise exposing a photothermographic recording material to a source of actinic radiation, the photothermographic recording material comprising a photo-addressable thermally developable element comprising a substantially light-insensitive organic silver salt, an organic reducing agent in thermal working relationship therewith, a photosensitive silver halide in a catalytic association with said substantially light-insensitive organic silver salt, a binder, and a polyhalide compound selected from the group consisting of quaternary ammonium polyhalides, quaternary phosphonium polyhalides and ternary sulphonium polyhalides, wherein said polyhalide compound satisfies a test having the following steps:

(i) preparing a silver behenate dispersion in deionized water by rapidly mixing with anionic sulfonate dispersion agent to produce a predispersion containing 20% by weight of silver behenate, homogenizing to a finely divided and stable dispersion and then adjusting the pH to about 6.5;

(ii) adding to 1.5 g of the silver behenate dispersion of (i) with stirring: 1 g of a 30% by weight dispersion of a latex-copolymer, 0.1 g of a 11% by weight solution of saponin in a mixture of deionized water and methanol and an aqueous solution of said polyhalide compound in a quantity corresponding to a concentration of 8 mol % with respect to the silver behenate present to produce a silver behenate/silver halide dispersion;

(iii) coating said silver behenate/silver halide dispersion of (ii) on a subbed polyethylene terephthalate support, drying said coating, then overcoating with a 2.44% by weight aqueous solution of 3-(3,4-dihydroxyphenyl)-propionic acid and drying to produce a test thermographic material;

(iv) exposing said test thermographic material of (iii) to ultraviolet light in an Agfa-Gevaert™ DL2000 exposure apparatus and heating on a metal block for 10 s at 95° C.; and (v) measuring the optical density of the exposure and thermally developed test material with a densitometer with a visible filter, wherein the test thermographic material has an optical density of less than 0.3; and (b) thermally developing the image-wise exposed photothermographic recording material.

18. The photothermographic recording process of claim 9 or 17, wherein the quaternary ammonium polyhalides, quaternary phosphonium halides and ternary sulphonium polyhalides are formed in a dispersion of particles of the substantially light-insensitive silver salt by metathesis between a salt with a polyhalide anion and an onium salt with an anion other than polyhalide.

19. An emulsion comprising a substantially light-insensitive organic silver salt, a photosensitive silver halide in catalytic association with said substantially light-insensitive organic silver salt, a binder, and a polyhalide compound selected from the group consisting of tetramethylammonium chloride perbromide, trimethylphenylammonium bromide perbromide and tetramethylammonium bromide perbromide, wherein said polyhalide compound may be formed in a dispersion of particles of the substantially light-insensitive silver salt by metathesis between a salt with a polyhalide anion and an onium salt with an anion other than polyhalide.

20. A photothermographic recording material, capable of image formation without preliminary heating prior to exposure, comprising: a photo-addressable thermally developable element comprising a substantially light insensitive organic silver salt, an organic reducing agent in thermal working relationship therewith, a photosensitive silver halide in catalytic association with said substantially light insensitive organic silver salt, a binder, and a polyhalide compound selected from the group consisting of tetramethylammonium chloride perbromide, trimethylphenylammonium bromide perbromide and tetramethylammonium bromide perbromide, wherein said polyhalide compound is formed in a dispersion of particles of the substantially light-insensitive silver salt by metathesis between a salt with a polyhalide anion and an onium salt with an anion other than polyhalide.

21. A photothermographic recording process comprising:

(a) image-wise exposing a photothermographic recording material to a source of actinic radiation, the photothermographic recording material comprising a photo-addressable thermally developable element comprising a substantially light-insensitive organic silver salt, an organic reducing agent in thermal working relationship therewith, a photosensitive silver halide in catalytic association with said substantially light-insensitive organic silver salt, a binder, and a polyhalide compound selected from the group consisting of tetramethylammonium chloride perbromide, trimethylphenylammonium bromide perbromide and tetramethylammonium bromide perbromide and wherein said polyhalide compound is formed in a dispersion of particles of the substantially light-sensitive silver salt by metathesis between a salt with a polyhalide anion and onium salts with anions other than polyhalide; and (b) thermally developing the image-wise exposed photothermographic recording material.

* * * * *